US005635972A

United States Patent [19]

Maruyama et al.

[11] Patent Number: 5,635,972

[45] Date of Patent: Jun. 3, 1997

[54] RESIDUAL RECORDING MATERIAL AMOUNT DETECTOR FOR LASER PRINTER

[75] Inventors: Akira Maruyama; Hiroshi Niki; Reiko Nagai, all of Nagano, Japan

[73] Assignee: Seiko Epson Corporation, Tokyo, Japan

[21] Appl. No.: 119,401

[22] Filed: Sep. 9, 1993

[30] Foreign Application Priority Data

Sep. 9, 1992 [JP] Japan ..... 4-266640
Dec. 22, 1992 [JP] Japan ..... 4-357045

[51] Int. Cl.[6] ..... B41J 2/385; G03G 9/08

[52] U.S. Cl. ..... 347/158; 399/30

[58] Field of Search ..... 347/133, 139, 347/140, 158; 355/206

[56] References Cited

U.S. PATENT DOCUMENTS 4,721,978 1/1988 Herley ..... 355/328
4,974,024 11/1990 Bares et al. ..... 355/246
5,096,180 3/1992 Nagaoka et al. ..... 271/110
5,160,966 11/1992 Shiina et al. ..... 355/206

FOREIGN PATENT DOCUMENTS 820106662 6/1982 Japan .
840063262 4/1984 Japan .
5330196 12/1993 Japan ..... 355/206

*Primary Examiner*—Benjamin R. Fuller
*Assistant Examiner*—L. Anderson
*Attorney, Agent, or Firm*—Stroock & Stroock & Lavan

[57] ABSTRACT

A residual recording material amount detector for a laser printer of the present invention is provided with a continuous dot number detecting device for counting a number of continuous video signals for modulating a laser light source, a toner consumption data storage device for storing a toner consumption per number of continuous dots, and an integrated toner consumption storage device implemented by a nonvolatile memory for storing an integrated value of toner consumptions at the time of forming a series of dots calculated by the continuous dot number detecting device and the toner consumption data storage device. According to the residual recording material amount detector for the laser printer of the present invention, the toner consumption can be detected correctly irrespective of the kind of data to be printed.

12 Claims, 9 Drawing Sheets

RESIDUAL RECORDING MATERIAL AMOUNT DETECTOR FOR LASER PRINTER

BACKGROUND OF THE INVENTION

The invention relates to a residual recording material amount detector suitable for use in a page printer that prints patterns on a recording sheet by forming a latent electrostatic image on a photoreceptor drum using a light beam modulated by print data and causing toner, which is the recording material, to electrostatically adhere to the latent electrostatic image.

With an apparatus for forming patterns on a recording sheet by causing toner to adhere to a latent electrostatic image formed on a photoreceptor drum, a tank containing the toner is accommodated inside a frame, and therefore the amount of residual toner cannot be visibly checked from the outside. To overcome this problem, a built-in sensor serving as a toner detecting device is usually arranged in the toner tank. In such a residual toner amount detecting system, uniform distribution of the toner inside the tank is often disturbed, which imposes the problem that the toner cannot be replaced in the manner of a cartridge, in addition to the problem that the detection accuracy is low.

To overcome this problem, residual recording material amount detectors for a page printer are proposed in Unexamined Japanese Patent Publications Nos. 224363/1983 and 208777/1985. These detectors are characterized as counting individual dot-forming image signals and multiplying such signals by a predetermined value. According to these detectors, since the total number of recorded dots is counted, the detection accuracy is successfully improved and the toner related members can be provided with a cartridge.

However, according to these detectors, the fact that the toner consumption per dot is calculated in advance, and that the toner consumption is multiplied by an integrated number of printed dots leads to the problem that the amount of the residual toner is detected in error depending on the kind of data to be printed.

SUMMARY OF THE INVENTION

The present invention has been made in view of the above circumstances. Accordingly, the object of the invention is to provide a novel residual recording material amount detector allowing the toner consumption to be detected correctly irrespective of the kind of print data.

To achieve the above object, the present invention is provided with a residual recording material amount detector for a laser printer, which includes a continuous dot number detecting device for counting a number of continuous video signals for modulating a laser light source, a toner consumption data storage device for storing a toner consumption per number of continuous dots, and an integrated toner consumption storage device implemented by a nonvolatile memory for storing an integrated value of toner consumptions at the time of forming a series of dots calculated by the continuous dot number detecting device and the toner consumption data storage device.

When printing is started, the continuity of pulse signals that modulate a laser light source is judged and the number of continuous dots is counted. Based on the count, data relating to the relationship between the number of continuous dots stored in advance and the tenet consumption is read, and the amounts of toner consumed by forming a series of dots are sequentially integrated.

BRIEF DESCRIPTION OF THE DRAWINGS

In the accompanying drawings.

DETAILED DESCRIPTION OF THE PREFERRED EMBODIMENT

Figure 1:
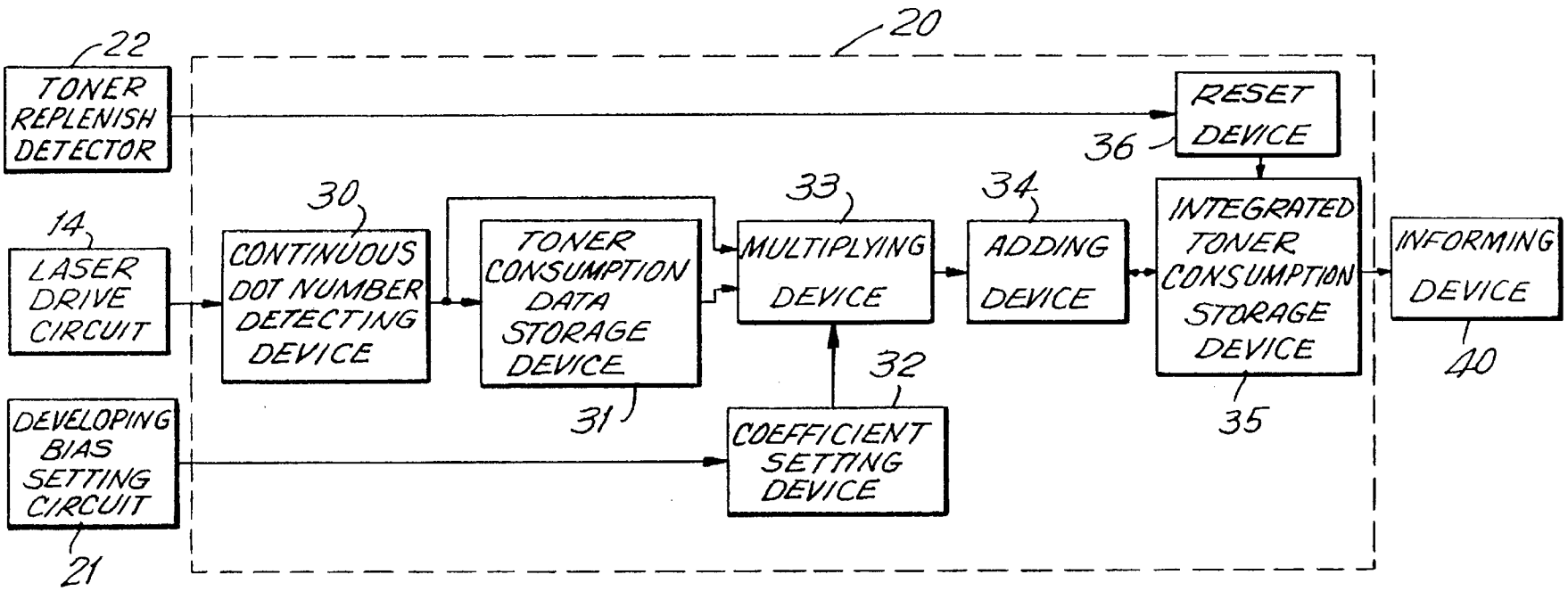
FIG. 1 is a block diagram showing a residual toner amount detector, which is an embodiment of the present invention.

Details of the present invention will hereunder be described with reference to embodiments shown in the drawings.

Figure 2:
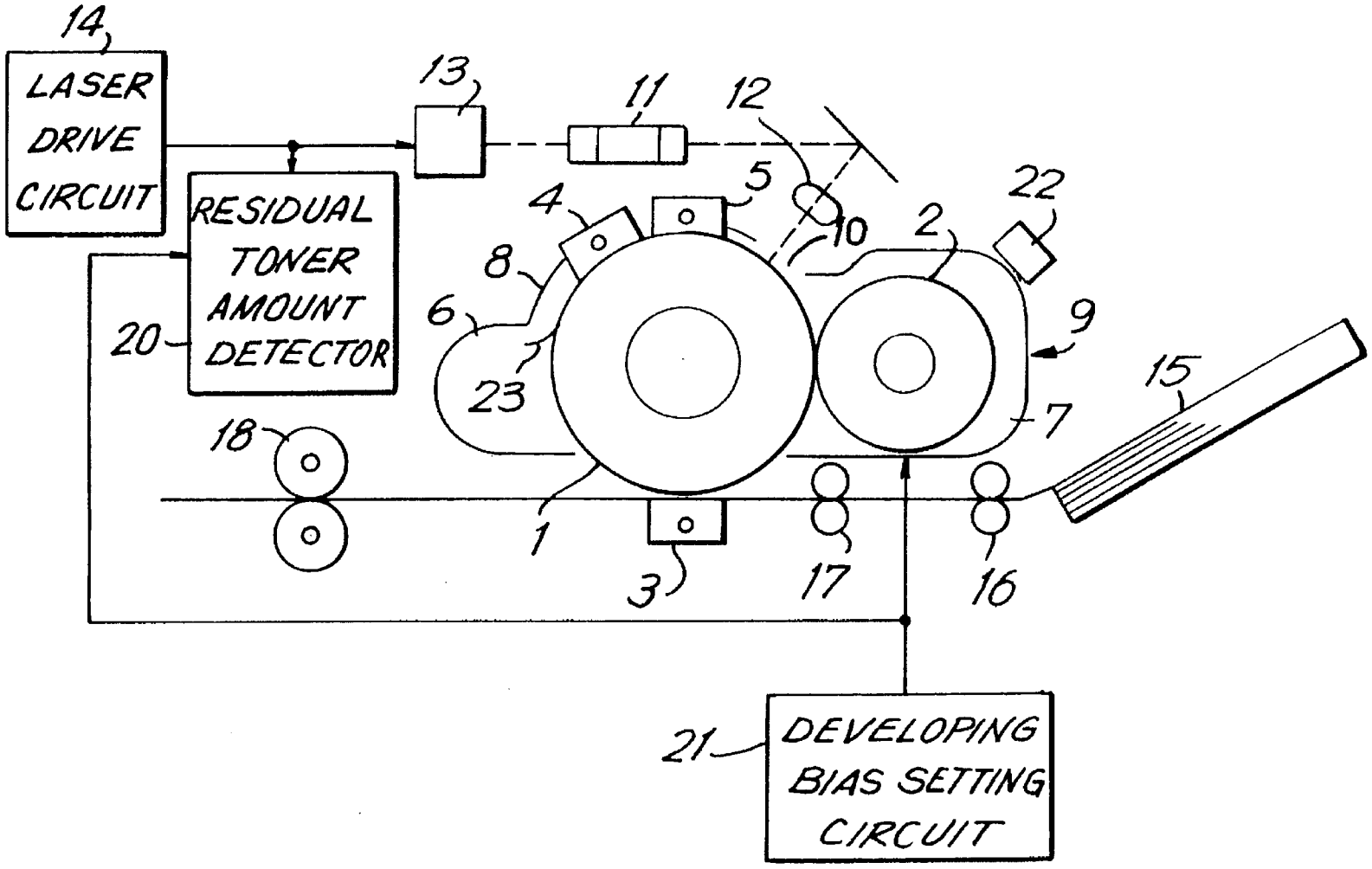
FIG. 2 is a diagram showing an example of a laser printer to which the present invention is applied.

FIG. 2 shows an example of a page printer to which the present invention is applied. In FIG. 2, reference numeral 1 designates a photoreceptor drum. Around the photoreceptor drum 1 are a developing roller 2, a transfer unit 3, an eraser 4, a charging unit 5, a waste toner tank 6, and a toner tank 7. Members relating to the toner, i.e., the photoreceptor drum 1, the developing roller 2, the waste toner tank 6, and the toner tank 7 are formed into a cartridge 9 while put in the same container 8.

Between the developing roller 2 and the charging unit 5 is a window 10 transmitting a laser beam. A beam scanned by a rotating polygon mirror 11 is injected through an Fθ lens 12 to form a latent electrostatic image on the photoreceptor drum 1. Reference numeral 13 designates a light-emitting device 13 such as a semiconductor laser element. The light-emitting device is turned on and off by a pulse signal from a laser drive circuit 14 that receives an input of print data from a print data output device (described later).

Between the transfer unit 3 and the photoreceptor drum 1 runs a sheet path. A recording sheet is introduced into the sheet path from a sheet feed cassette 15 by sheet feed rollers 16 and 17, is subjected to a transfer process so that a toner image on the photoreceptor drum 1 is transferred thereon, and is then delivered to a fixing unit 18.

Reference numeral 20 designates a residual toner amount detector that is a feature of the present invention. The residual toner amount detector receives print data from the laser drive circuit 14 and a bias signal from a developing bias setting circuit 21.

Reference numeral 22 designates a toner replenish detector. Since the toner tank 7 is a part of the photoreceptor drum cartridge 9 in which the toner tank 7 is integrated with the photoreceptor drum 1 in this embodiment, the toner replenish detector 22 is designed to output a signal upon replacement of the photoreceptor drum 1. In the case where toner is replenished in the form of a toner cartridge 9 that contains toner in a tank container, it may be so designed that the toner replenish detector 22 outputs a signal upon replacement of the toner cartridge 9. A replenish end instruction switch may be arranged on a panel, so that a user can reset the toner replenish detector 22 after the toner replenish operation has been completed. Various other device may be arranged in this way.

FIG. 1 shows an example of the above-described residual toner amount detector 20. This detector includes: a continuous dot number detecting device 30 for detecting the number of continuous dots to be printed upon reception of a signal from the laser drive circuit 14; a toner consumption data storage device 31 for storing the relationship data between the number of continuous dots and the toner consumption per dot at the time of printing such number of continuous dots, and for reading out the toner consumption per dot in accordance with the number of continuous dots; a multiplying device 33 for obtaining a product of the toner consumption per dot and the number of continuous dots, or such product taking into account a coefficient applied from a coefficient setting device 32 if necessary; an adding device 34 for obtaining a sum of data stored in an integrated toner consumption storage device 35 and data from the multiplying device 33 and storing the sum in the integrated toner consumption storage device; and the integrated toner consumption storage device 35 implemented by a nonvolatile memory that is reset by a signal from a reset device 36.

Figure 3:
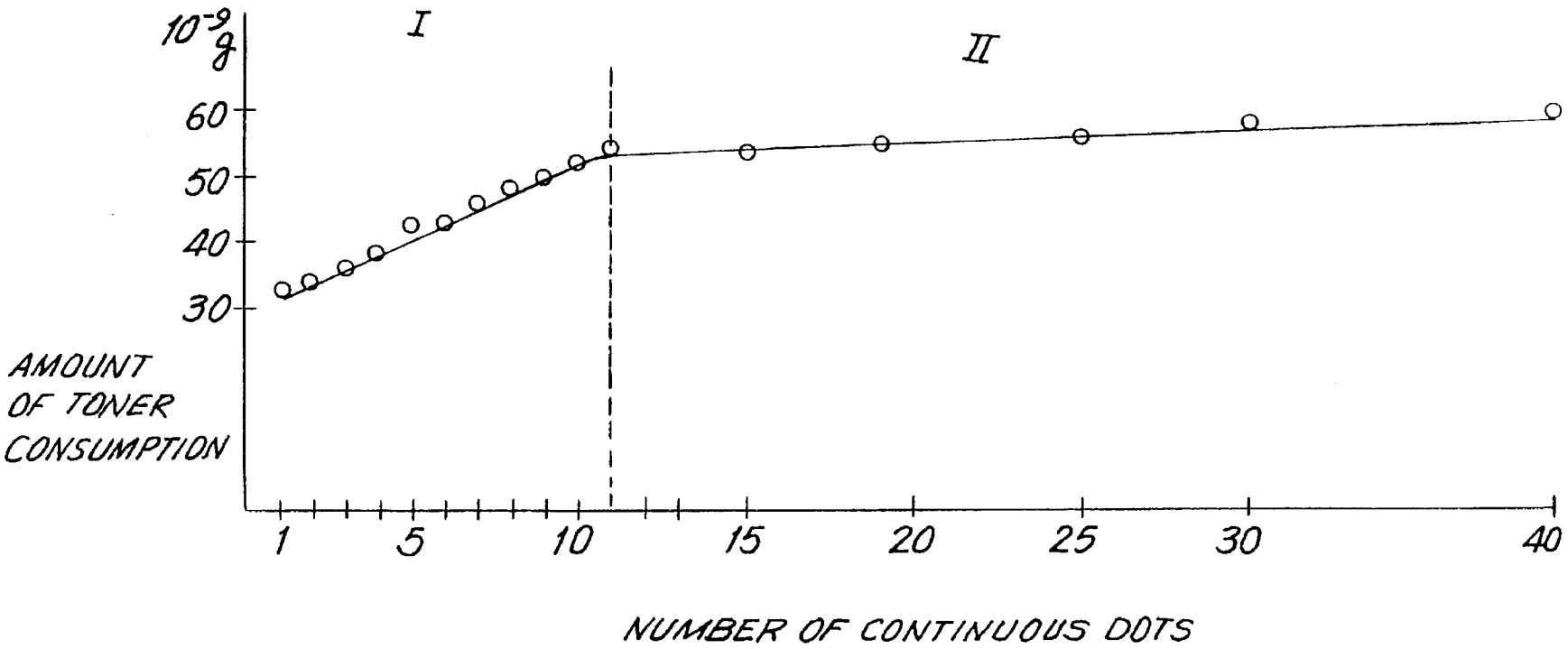
FIG. 3 is an exemplary relationship between the number of continuous dots and the toner consumption per dot at the time such number of continuous dots are printed.

As shown in FIG. 3, the toner consumption data storage device 31 is divided into two areas: an area I in which the toner consumption per dot increases with increasing number of continuous dots (the number of continuous dots belonging to the area I being 1 to 12) and an area II in which the toner consumption per dot stays almost constant irrespective of the number of continuous dots (the number of continuous dots belonging to the area II being 12 or more). The area I stores a toner consumption per number of dots and the area II stores a representative value, e.g., an average toner consumption per dot for the continuous dots 12 to 40.

Figure 4:
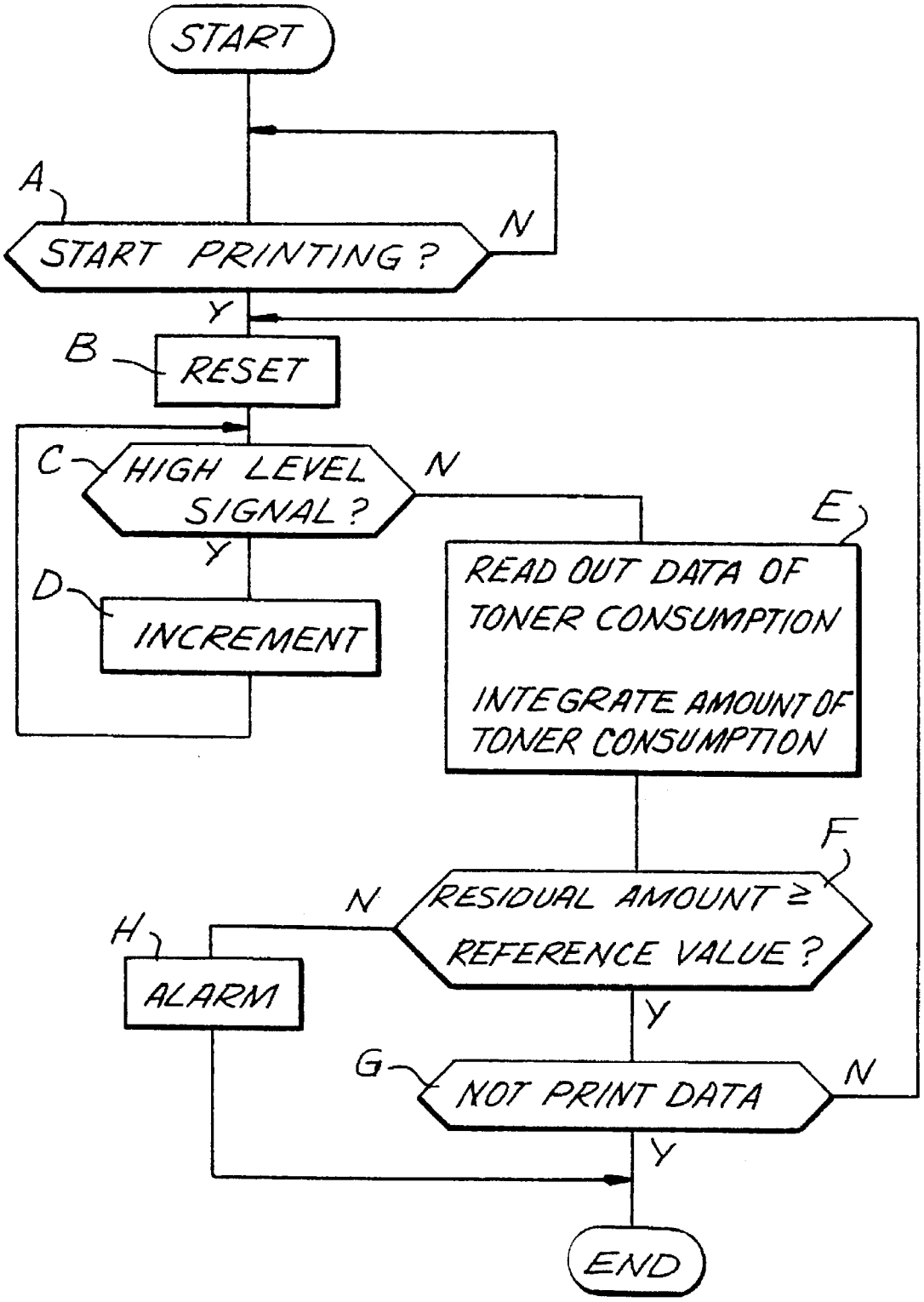
FIG. 4 is a flowchart showing an operation of the residual toner amount detector of FIG. 1.

An operation of the thus constructed residual toner amount detector 20 will be described with reference to a flowchart shown in FIG. 4.

Upon input of print data from a host (Step A), bit map data corresponding thereto is developed in a graphic memory. Upon end of a predetermined development, the bit mad data is converted into a serial signal and output to the laser drive circuit 14. As a result, the laser light source 13 emits light when a video signal goes high and is turned off when the video signal goes low.

At the same time, this video signal is applied to the residual toner amount detector 20. Since this is an initial data input, the continuous dot number detecting device 30 is first reset (Step B), and then counts the number of laser turn on signals while dots are continuously generated (Steps C, D). When the laser turn on signal disappears after a series of dot generating operations have been ended in such a manner, the continuous dot number detecting device 30 stops counting. The amount of a toner consumption per dot consumed by the generation of a series of dots is read out from the toner consumption storage device 31. A calculated product of the toner consumption per dot and the number of dots counted by the continuous dot number detecting device 30 is applied to the adding device 34.

The adding device 34 adds the amount of the toner consumed by generating a series of dots to the past consumption data stored in the integrated toner consumption storage device 35, and updates the integrated toner consumption storage device 35 by storing the sum therein again (Step E). This process is repeated every time dots are printed, so that the toner consumption is integrated (Step G).

On the other hand, when the value in the integrated toner consumption storage device 35 has reached a preset reference value (Step F), a toner cartridge replacement instruction is given to an informing device 40. When the cartridge 9 is replaced in accordance with the instruction, a signal is applied from the toner replenish detector 22 to reset the integrated toner consumption storage device 35, so that the integrated toner consumption data is zeroed.

Accuracy in calculating the toner consumption with the thus constructed residual toner amount detector 20 is evaluated. The results are as shown in Tables 1 and 2.

Figure 5:
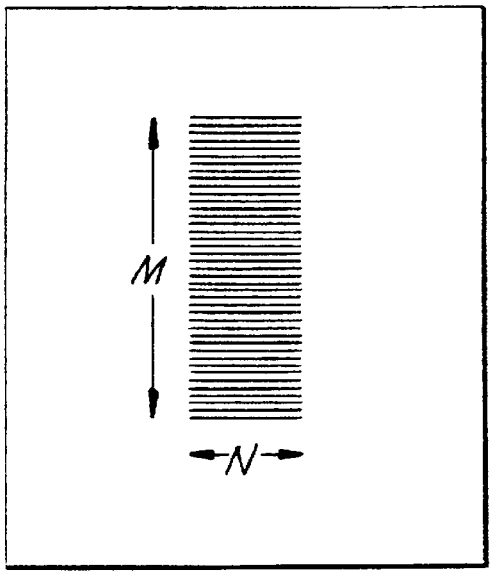
FIG. 5 is a diagram illustrating an exemplary print sample referred to for measuring and calculating a toner consumption.

In the evaluation, five print samples, an exemplary one of which is shown in FIG. 5, are used. Each print sample is formed by printing 1000 lines, each line having a length N (N being 1, 3, 6, 20, and 1000 dots). The measured value is obtained by dividing an increment in weight by the total number of dots in each sample. Other values are calculated values.

TABLE 1

| Number of dots N | 1 | 3 | 6 | 20 | 1000 |
|---|---|---|---|---|---|
| Measured values | 3.18 | 10.7 | 25.3 | 54.0 | 55.0 |
| Present invention | 3.18 | 11.3 | 22.6 | 55.4 | 55.4 |
| Conventional method | 4.95 | 14.9 | 29.7 | 49.5 | 49.5 |

(Unit: $10^{-5}$g)

As is apparent from Table 1, the calculated values obtained by the method of the present invention is substantially the same as the measured values, whereas the calculated values obtained by the conventional method, in which the average toner consumption per dot is multiplied by the total number of dots, contain relatively large error. In fact, as shown in Table 2, the residual toner amount detector 20 of the present invention exhibits about 10% error at the maximum and a few percent or less error on the average, whereas the conventional method exhibits 55% error at the maximum and 10% or more error on the average.

TABLE 2

| Number of dots N | 1 | 3 | 6 | 20 | 1000 |
|---|---|---|---|---|---|
| Present invention | 0 | +5.0 | −10.7 | +2.6 | +0.7 |
| Conventional method | +55 | +39.0 | +17.3 | −8.3 | −10.0 |

(Unit: %)

Figure 6:
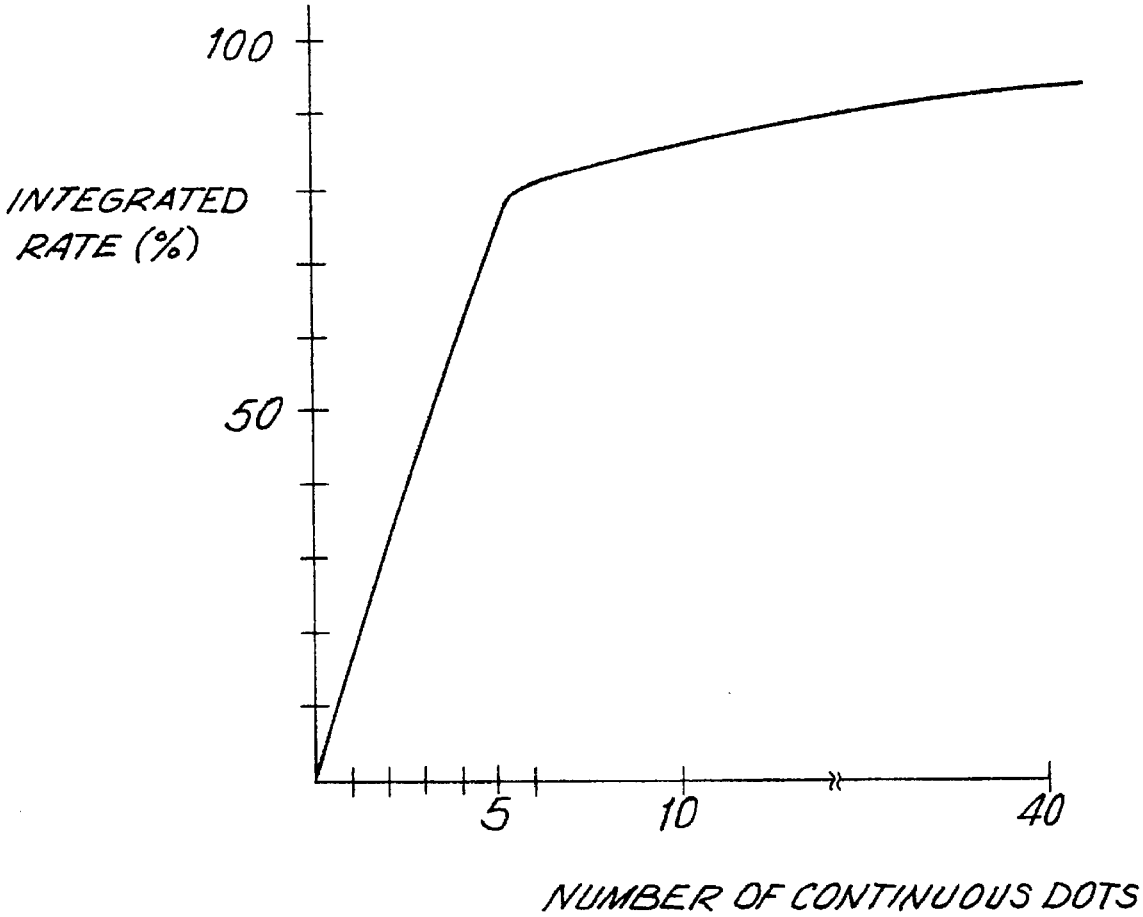
FIG. 6 is a diagram illustrating the frequency of continuous dots for forming a character pattern.

Particularly, with respect to patterns such as text data made up of combinations of short segments, those including segments consisting of 8 dots or less account for 80% of the total as shown in FIG. 6. Therefore, the accuracy in the area for the small number of dots greatly affects the accuracy in calculating the total toner consumption. It is for this reason that the present invention is far better in calculation accuracy than the conventional method.

By the way, the toner consumption is directly affected by the density of an image to be formed, and the density is affected by the secular change of the photoreceptor drum and the developing bias. To avoid these influences, the coefficient setting device 32 is additionally provided to the multiplying device 33. By applying data from the developing bias setting circuit 21 to the coefficient setting device 32, an increment or decrement in toner consumption attributable to density is automatically set. Further, by periodically applying the rate of secular change of the photoreceptor drum 1, or by applying data to be consumed due to stained texture, the toner consumption can be calculated more correctly.

While it is the integrated toner consumptions that are calculated in this embodiment, it is apparent that the same advantage can be obtained by sequentially subtracting the amount of toner consumed by printing from the total amount of toner supplied to the toner cartridge.

While the consumption per dot is detected in this embodiment, it is apparent that the same advantage can be obtained by integrating the toner consumption for the total number of continuous dots. That is, in the area I in which the toner consumption per dot depends largely on the number of continuous dots, the total toner consumption for the number of continuous dots is used as data, whereas in the area II in which the toner consumption per dot does not depend on the number of continuous dots, a representative value of the toner consumption per dot is stored. The readout data are added up without further processing for area I, whereas the readout data are added up after multiplied by the number of dots for area II.

While a monochromatic laser printer has been taken as an example in the above embodiment, it is apparent that the same advantage can be obtained by applying the present invention to a graphic printer that forms digital image using color toners. In this case, the residual toner amount detector 20 may be arranged per color signal.

The toner consumption per number of dots is stored as data for the area I in which the consumption depends largely on the number of continuous dots in the above embodiment. If more areas, e.g., 3 or more areas are provided to allow a representative value per area to be stored as data, then the residual toner amount detector 20 can be implemented by a small memory.

While the relationship between the number of continuous dots and the toner consumption is calculated based on data stored in dictionary form in this embodiment, it is apparent that the same advantage can be obtained by expressing the relationship in function form.

Figure 7:
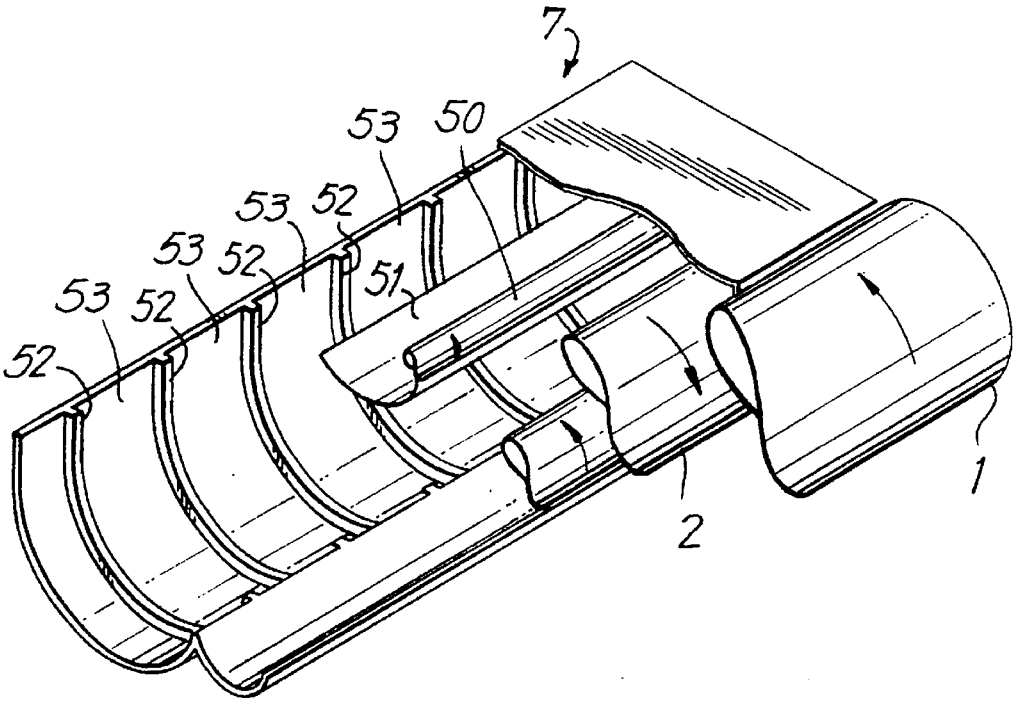
FIG. 7 is a perspective view showing an exemplary developing unit of a page printer.

By the way, the tank 7 assembled in the cartridge 9 (FIG. 1) is mounted on a rotating shaft 50 as shown in FIG. 7. Toner is electrically charged while stirred at all times during printing by a stirring blade 51 whose end is in slidable contact with the inner circumferential surface of the tank 7, and supplied to the developing roller 2 irrespective of the residual. To avoid unnecessary friction between the stirring blade 51 and the inner circumferential surface of the tank, ribs 52 are arranged on the inner circumferential surface at a predetermined interval in the axial direction, the ribs extending in the radial direction.

Figure 8:
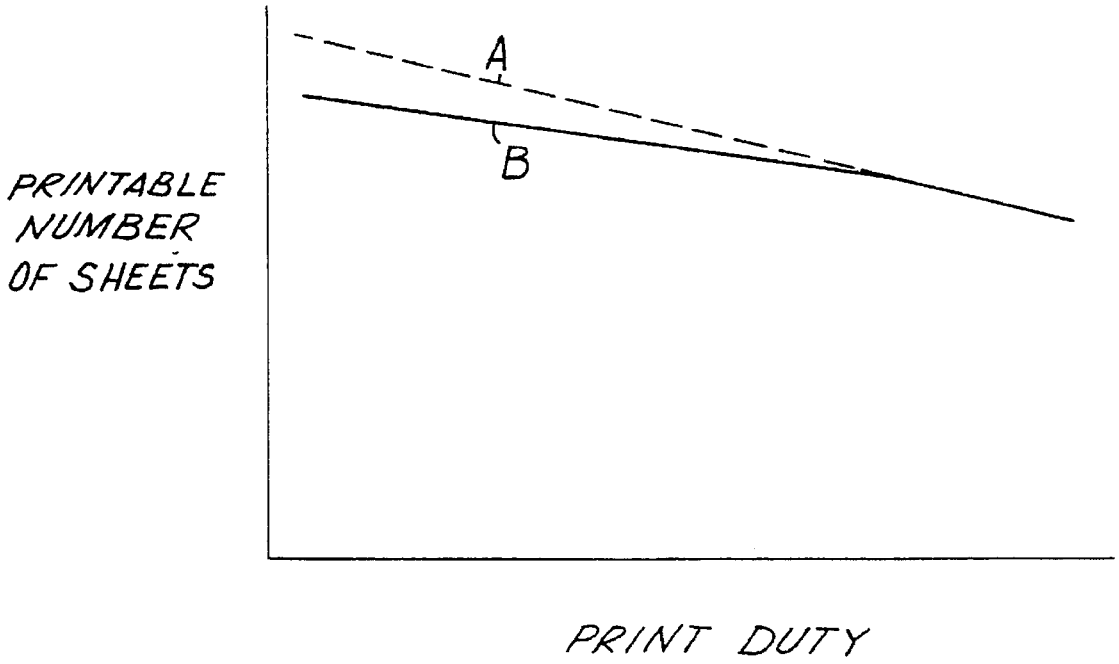
FIG. 8 is a diagram showing a relationship between the print duty and the printable number of sheets.

According to such a construction, the destruction of the toner by the friction between the inner circumferential surface of the tank and the stirring blade 51 can be prevented as much as possible. On the other hand, the toner having entered into spaces 53 provided by the ribs 52 is solidified while gradually pressed in association with the rotation of the stirring blade 51, thereby imposing the problem that the amount of toner to be supplied for developing while maintaining the form of powder is substantially reduced. As shown in FIG. 8, ideally, the printable number of sheets is inversely proportional to the print duty (as shown by a line A). However, if the duty is low, the printable number of sheets becomes smaller than that shown by the line A (as shown by a line B). This device that printing is impossible with the toner having run out although the amount of residual toner is nominally sufficient for printing.

Figure 9:
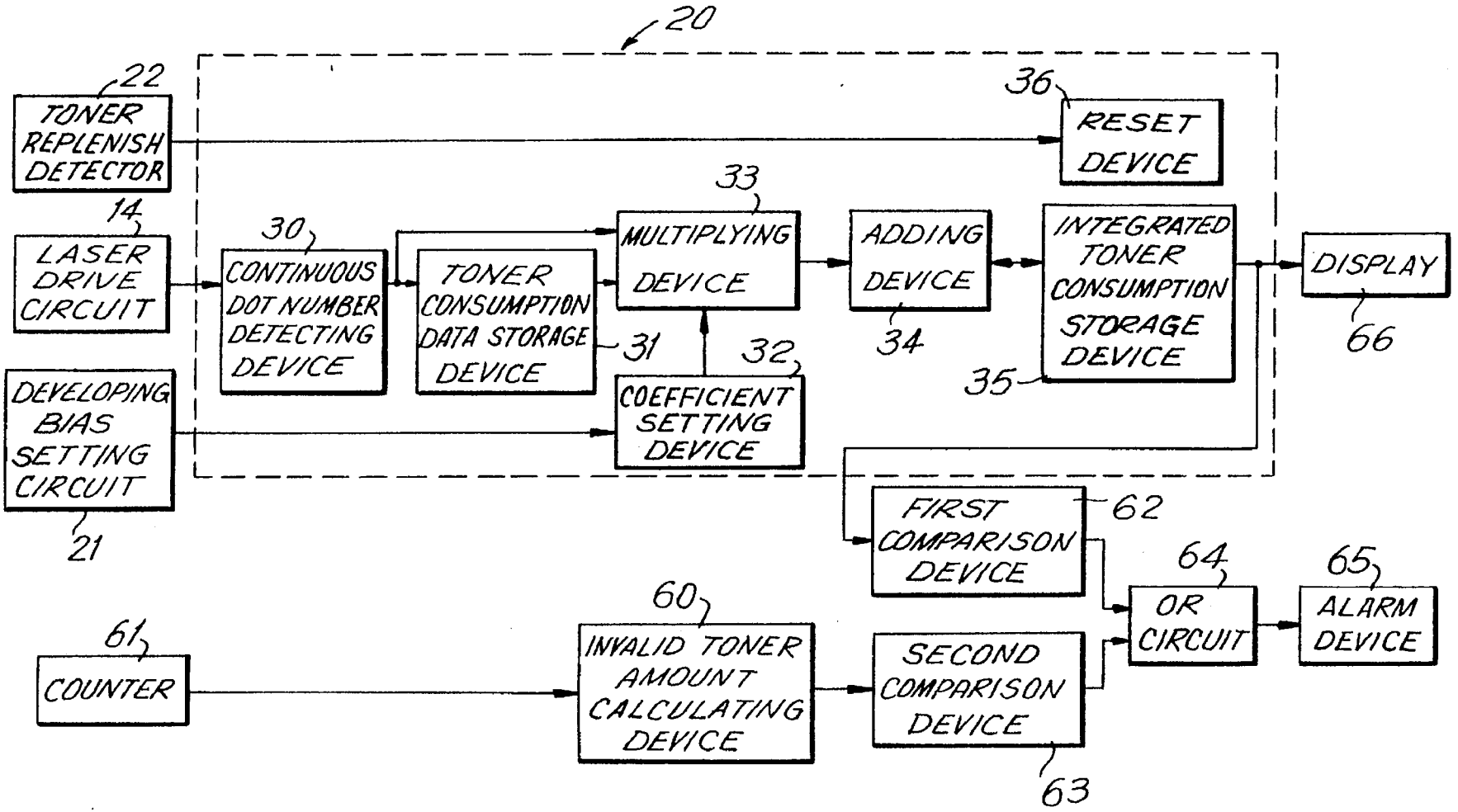
FIG. 9 is a block diagram showing a residual toner amount detector, which is another embodiment of the present invention.

FIG. 9 shows an embodiment that can take care of the problem to be caused by printing large amounts of low print duty data. In FIG. 9, reference numeral 60 designates an invalid toner amount calculating device, which calculates the amount of toner compressed and solidified in the spaces between the ribs 52 in response to the number of printed sheets from a counter 61 for counting the number of printed sheets. That is, the amount of toner that has been solidified by the stirring blade 51 and can therefore no longer be used for developing is in a predetermined ratio to one pass of the stirring blade 51, e.g., several tens mg/pass. Therefore, by multiplying this ratio by a product of the integrated number of printed sheets in the counter 61 and the size of a recording sheet, i.e., the effective operation time of the developing unit, such amount of toner can be calculated.

Reference numerals 62, 63 respectively designate a first comparison device and a second comparison device, each of which compares data from the integrated toner consumption storage device 35 and the invalid toner amount calculating device 60 with a preset alarm reference, and outputs a signal when the data coincides with the alarm reference. These signals are applied to an OR circuit 64 to operate an alarm device 65.

In this embodiment, the residual toner amount detector 20 calculates the toner consumption every time print data is output from the host, and the invalid toner amount calculating device 60 calculates, upon reception of the integrated number of printed sheets from the counter 61, the amount of toner that cannot be used due to having been compressed and solidified inside the tank. These data are fed to the first comparison device 62 and the second comparison device 63, and compared with the alarm reference.

Under the condition that the toner still remains in such an amount as to allow printing of several hundreds of sheets although the residual toner is decreased to an extremely small amount as the integrated number of printed sheets is increased in this way, a relatively large amount of toner is compressed and solidified on the inner peripheral surface of the tank. As a result, the data from the invalid toner amount calculating device 60 reaches the alarm reference, thereby causing the alarm device 65 to intervene to give an alarm urging the user to replenish toner.

This system can give a toner shortage alarm without fail irrespective of differences between the integrated toner consumption or the residual toner data on a display 66 and the valid residual toner amount, such differences tending to be found often in printing low print duty data in large amounts.

Figure 10:
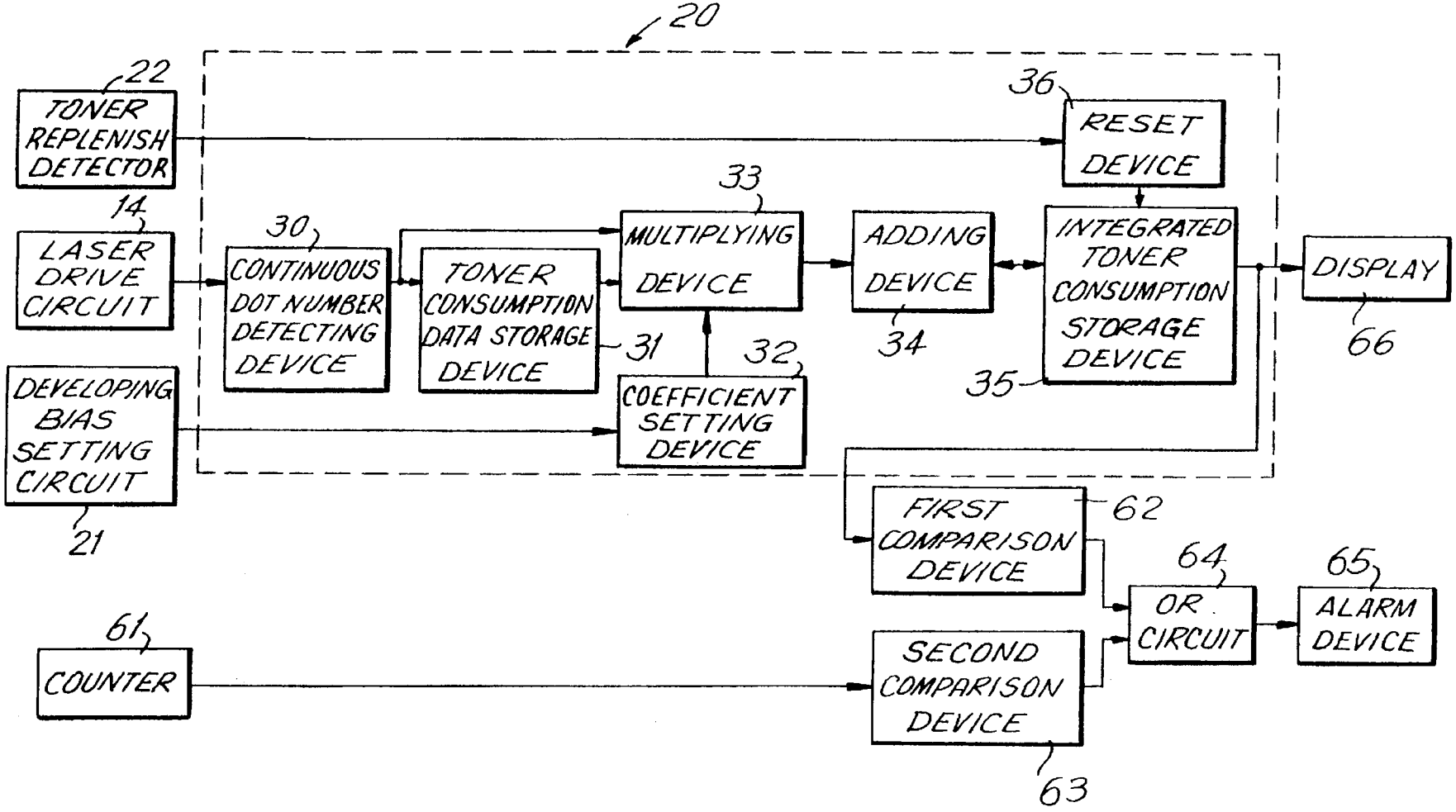
FIG. 10 is a block diagram showing a residual toner amount detector, which is still another embodiment of the present invention.

In the above-described embodiment, the amount of unusable solidified toner is calculated by multiplying the ratio by the integrated number of printed sheets. If the ratio is practically constant irrespective of the integrated number of printed sheets, then it is apparent that the same advantage can be obtained by giving an alarm when the number of printed sheets coincides with the alarm reference by directly inputting the number of printed sheets to the second comparison device as shown in FIG. 10.

Figure 11:
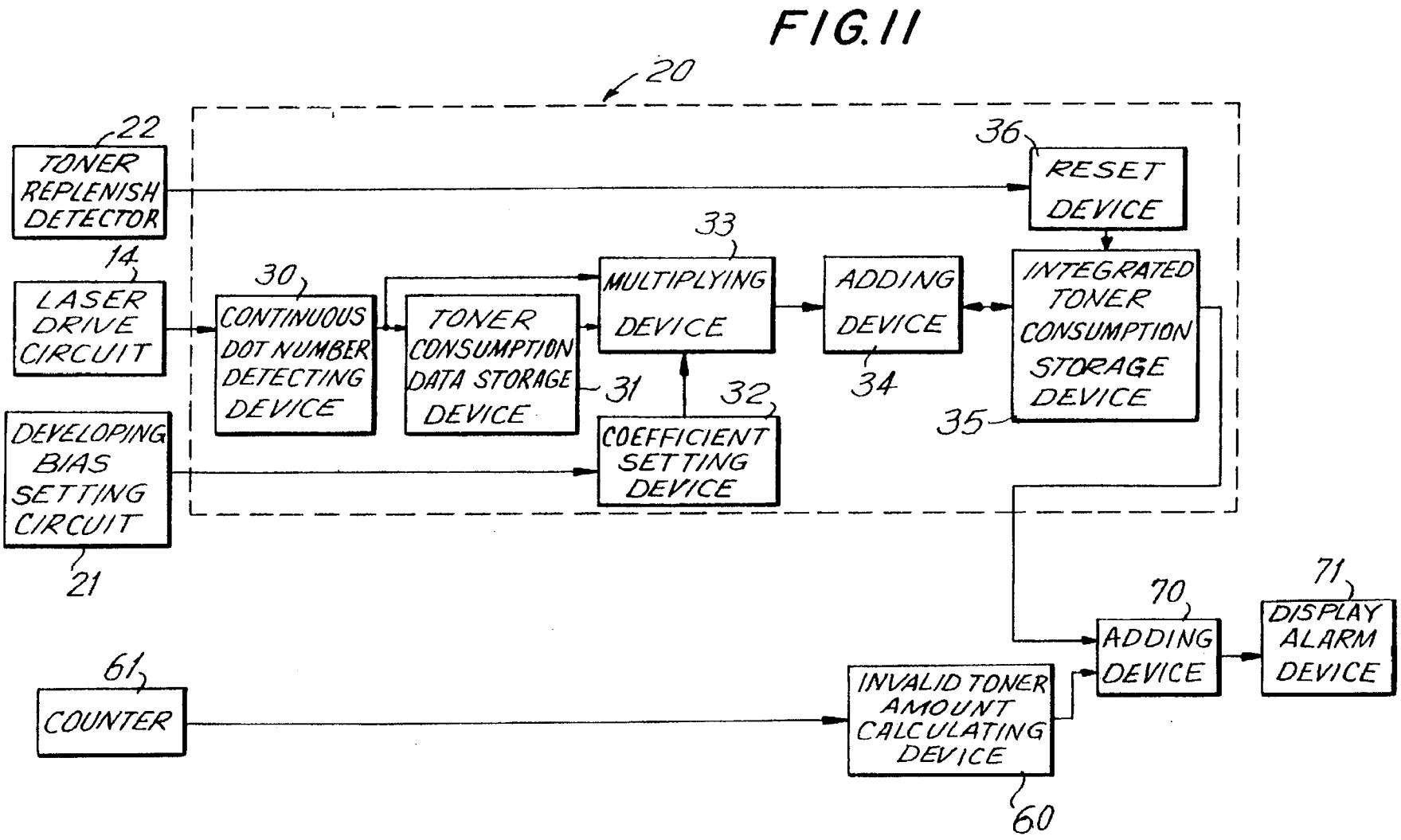
FIG. 11 is a block diagram showing a residual toner amount detector, which is still another embodiment of the present invention.

FIG. 11 shows a third embodiment of the present invention. This embodiment is characterized as applying data in the invalid toner amount calculating device 60 and data in the integrated toner consumption storage device 35 to an adding device 70 and outputting data in the adding device 70 to a display alarm device 71. According to this embodiment, the toner consumption data on display corresponds to the toner shortage alarm.

As described above, the present invention is characterized as including: a continuous dot number detecting device that counts the number of continuous video signals for modulating a laser light source; a toner consumption data storage device for storing a toner consumption per number of continuous dots; and an integrated toner consumption storage device implemented by a nonvolatile memory for storing an integrated value of toner consumptions at the time of forming a series of dots calculated by the continuous dot number detecting device and the toner consumption data storage device. Therefore, the toner consumption can be detected correctly irrespective of the kind of data to be printed.

What is claimed is:

1. A residual recording material amount detector for a laser printer comprising:

a continuous dot number detecting means for counting a number of continuous dots printed and producing a continuous dot number;

a toner consumption data storage means for receiving the continuous dot number, storing a toner consumption per number of said continuous dots, the toner consumption for a particular dot varying as a function of the value of the continuous dot number, and producing a value corresponding to a amount of toner consumed per dot consumed by generation of a series of dots; and an integrated toner consumption storage means operatively coupled to said continuous dot number detecting means and toner consumption data storage means for storing an integrated value of toner consumptions at a time of forming said series of dots calculated by said continuous dot number detecting means and said toner consumption data storage means.

2. The residual recording material amount detector of claim 1, further comprising a multiplying means for receiving said continuous dot number and said value and producing a product of said toner consumption per dot and said number of said continuous dots.

3. The residual recording material amount of claim 2, further comprising adding means for receiving said product and producing a sum of data stored in said integrated toner consumption storage means and data obtained from said multiplying means, wherein said sum obtained by said adding means is stored in said integrated toner consumption storage means again.

4. A residual recording material amount detector for a laser printer comprising:

a continuous dot number detecting means for counting a number of continuous dots to be printed and producing a continuous dot number:

a toner consumption data storage means for receiving the continuous dot number, storing a toner consumption per number of said continuous dots, and producing a value corresponding to the amount of toner consumed per dot consumed by the generation of a series of dots;

an integrated toner consumption storage means operatively coupled to said continuous dot number detecting means and toner consumption data storage means for storing an integrated value of toner consumptions at the time of forming said series of dots calculated by said continuous dot number detecting means and said toner consumption data storage means; and said toner consumption data storage means further stores said toner consumption per number of continuous dots by dividing said number of continuous dots into at least two levels, and then said toner consumption data storage means stores toner consumption in accordance with said respective levels.

5. A residual recording material amount detector for a laser printer comprising:

a continuous dot number detecting means for counting a number of continuous dots to be printed and producing a continuous dot number;

a toner consumption data storage means for receiving the continuous dot number, storing a toner consumption per number of said continuous dots, and producing a value corresponding to the amount of toner consumed per dot consumed by the generation of a series of dots;

an integrated toner consumption storage means operatively coupled to said continuous dot number detecting means and toner consumption data storage means for storing an integrated value of toner consumptions at the time of forming said series of dots calculated by said continuous dot number detecting means and said toner consumption data storage means:

a multiplying means for receiving said continuous dot number and said value and producing a product of said toner consumption per dot and said number of said continuous dots:

adding means for receiving said product and producing a sum of data stored in said integrated toner consumption storage means and data obtained from said multiplying means, wherein said sum obtained by said adding means is stored in said integrated toner consumption storage means again; and a coefficient setting means for setting a variable rate of the toner consumption affected by a density of an image to be formed and outputting a coefficient, wherein said multiplying means also receives said coefficient and produces a product of said toner consumption per dot and said number of said continuous dots using said coefficient produced by said coefficient setting means.

6. A residual recording material amount detector for a laser printer comprising:

a continuous dot number detecting means for counting a number of continuous video signals for modulating a laser light source and producing a continuous dot number;

a toner consumption data storage means for receiving said continuous dot number and storing a toner consumption per number of continuous dots, the toner consumption for a particular dot varying as a function of a value of the continuous dot number, and outputting a toner consumption value;

an integrated toner consumption storage means operatively coupled to the continuous dot number detecting means and said toner consumption data storage means for storing an integrated value of toner consumptions for forming a series of dots calculated by said continuous dot number detecting means and said toner consumption data storage means;

a printed sheet detecting means for counting a number of printed sheets and outputting a signal when a value calculated from said number of printed sheets reaches a preset value; and an alarm signal generating means for receiving said signal and said integrated value and generating an alarm signal in accordance with said signal output from said printed sheet detecting means and said integrated value stored in said integrated toner consumption storage means.

7. The residual recording material amount detector of claim 6, wherein said printed sheet detecting means comprises a counter for counting said number of printed sheets.

8. A residual recording material amount detector for a laser printer comprising:

a continuous dot number detecting means for counting a number of continuous video signals for modulating a laser light source and producing a continuous dot number;

a toner consumption data storage means for receiving said continuous dot number and storing a toner consumption per number of continuous dots and outputting a toner consumption value;

an integrated toner consumption storage means operatively coupled to the continuous dot number detecting means and said toner consumption data storage means for storing an integrated value of toner consumptions for forming a series of dots calculated by said continuous dot number detecting means and said toner consumption data storage means;

a printed sheet detecting means for counting a number of printed sheets, and for outputting a signal when a value calculated from said number of printed sheets reaches a preset value, said printed sheet detecting means comprises an invalid toner amount calculating device for multiplying a predetermined ratio by a product of said number of printed sheets and an operation time of a developing unit to print a single sheet of said laser printer;

an alarm signal generating means for receiving said signal and said integrated value and generating an alarm signal in accordance with said signal output from said printed sheet detecting means and said integrated value stored in said integrated toner consumption storage means; and said printed sheet detecting means including a counter for counting said number of printed sheets.

9. A residual recording material amount detector for a laser printer comprising:

a continuous dot number detecting means for counting a number of continuous video signals for modulating a laser light source and producing a continuous dot number;

a toner consumption data storage means for receiving said continuous dot number and storing a toner consumption per number of continuous dots, toner consumption for a particular dot being a function of the continuous dot number, and outputting a toner consumption value;

an integrated toner consumption storage means operatively coupled to the continuous dot number detecting means and said toner consumption data storage means for storing an integrated value of toner consumptions for forming a series of dots calculated by said continuous dot number detecting means and said toner consumption data storage means;

a printed sheet detecting means for counting a number of printed sheets and outputting a signal when a value calculated from said number of printed sheets reaches a preset value:

an alarm signal generating means for receiving said signal and said integrated value and generating an alarm signal in accordance with said signal output from said printed sheet detecting means and said integrated value stored in said integrated toner consumption storage means; and said alarm signal generating means includes a first comparison device for comparing said signal from said printed sheet detecting means with a present alarm reference and a second comparison device for comparing said integrated value from said integrated toner consumption storage means with a preset alarm reference, and said alarm signal generating means generates said alarm signal by logically summing signals from said first and second comparison device.

10. A residual recording material amount detector for a laser printer comprising:

a continuous dot number detecting means for counting a number of continuous video signals for modulating a laser light source and producing a continuous dot number;

a toner consumption data storage means for receiving said continuous dot number and storing a toner consumption per number of continuous dots, toner consumption for a particular dot being a function of the continuous dot number, and outputting a toner consumption value;

an integrated toner consumption storage means operatively coupled to the continuous dot number detecting means and said toner consumption data storage means for storing an integrated value of toner consumptions for forming a series of dots calculated by said continuous dot number detecting means and said toner consumption data storage means;

a printed sheet detecting means for counting a number of printed sheets and outputting a signal when a value calculated from said number of printed sheets reaches a preset value; and an alarm signal generating means for receiving said signal and said integrated value and generating an alarm signal in accordance with said signal output from said printed sheet detecting means and said integrated value stored in said integrated toner consumption storage means;

said alarm signal generating means generating said alarm signal in response to a value obtained by adding said signal output from said printed sheet detecting means to said integrated value stored in said integrated toner consumption storage: means.

11. A residual recording material mount detector for a laser printing comprising:

a continuous dot number detecting means for counting a number of continuous dots to be printed and producing a continuous dot number;

a toner consumption data storage means for storing a toner consumption per number of said continuous dots, receiving the continuous dot number, and producing a value corresponding to an amount of toner consumed per dot consumed by generation of dots, the toner consumption for a particular dot varying as a function of the value of the continuous dot number; and a toner consumption storage means operatively coupled to said continuous dot number detecting means and toner consumption storage means for sequentially subtracting a value of toner consumptions at a time of forming said series of dots, calculated as a function of said continuous dot number and said value by said continuous dot number detecting means and said toner consumption data storage means, from a preset total amount of toner supplied to a toner cartridge.

12. A method for detecting a residual amount of a recording material for a laser printer comprising the steps of:

(a) detecting a number of continuous dots by counting a number of laser turn on signals while dots to be printed are generated continuously;

(b) reading out an amount of a toner consumption per dot consumed by generation of a series of dots, the toner consumption for a particular dot varying as a function of the value of the continuous dot number;

(c) calculating a product of said toner consumption per dot and said number of continuous dots;

(d) integrating said toner consumption by repeating said steps (a), (b) and (c) every time dots are printed;

(e) instructing replacement of a toner cartridge when said integrated toner consumption has reached a preset reference value; and (f) resetting a value of said integrated toner consumption when said toner cartridge is replaced.

* * * * *